US006800588B2

(12) United States Patent
Iwasaki et al.

(10) Patent No.: US 6,800,588 B2
(45) Date of Patent: Oct. 5, 2004

(54) THERMAL RECORDING MATERIAL

(75) Inventors: Masayuki Iwasaki, Shizuoka-ken (JP); Takayuki Matsumoto, Shizuoka-ken (JP); Tetsuo Takeuchi, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 106 days.

(21) Appl. No.: 10/000,063

(22) Filed: Dec. 4, 2001

(65) Prior Publication Data

US 2002/0155950 A1 Oct. 24, 2002

(30) Foreign Application Priority Data

| | | |
|---|---|---|
| Dec. 4, 2000 | (JP) | 2000-368036 |
| Jan. 17, 2001 | (JP) | 2001-009106 |
| Dec. 3, 2001 | (JP) | 2001-369255 |

(51) Int. Cl.[7] ..... B41M 5/40
(52) U.S. Cl. ..... 503/226; 503/200
(58) Field of Search ..... 503/200, 226

(56) References Cited

U.S. PATENT DOCUMENTS 4,758,547 A 7/1988 Itabashi et al.
6,410,479 B1 * 6/2002 Fukuchi et al. ..... 503/226

FOREIGN PATENT DOCUMENTS

| | | |
|---|---|---|
| JP | 0 366 461 A2 | 5/1990 |
| JP | 0 400 485 A2 | 12/1990 |
| JP | 11-198529 | 7/1999 |
| JP | 11-314457 | 11/1999 |
| JP | 0 995 613 A2 | 4/2000 |
| JP | 3176941 | 4/2001 |
| JP | 1 195 260 A2 | 4/2002 |

OTHER PUBLICATIONS

Translation of JP 11–314457.*

Patent Abstract of Japan, 11–198529, Jul. 27, 1999.

Patent Abstract of Japan, 11–314457, Nov. 16, 1999.

Patent Abstract of Japan, 04–216991, Aug. 7, 1992.

* cited by examiner

*Primary Examiner*—B. Hamilton Hess
(74) *Attorney, Agent, or Firm*—Sughrue Mion, PLLC

(57) ABSTRACT

A thermal recording material having a thermal color-forming layer which contains an electron-donating leuco-dye and an electron-receiving compound, and a protective layer formed in that order on a support. The protective layer of the material contains an inorganic dye and at least one of an amide-denatured polyvinyl alcohol and a diacetone-denatured polyvinyl alcohol.

16 Claims, No Drawings

THERMAL RECORDING MATERIAL

BACKGROUND OF THE INVENTION

1. Field of the Invention

The present invention relates to a thermal recording material, in particular to one having the advantages of high sensitivity, high-density color image formation thereon, good resistance to plasticizers, good resistance to ink for inkjet systems, good traveling in processing and printing systems, good handlability (resistance to rubbing), and good printability.

2. Description of the Related Art

Reaction of a basic leuco-dye with an organic acid substance when melted under heat to form colors has been known in the art. The color-forming reaction applies to various types of recording paper (thermal recording materials).

As being relatively inexpensive and capable of being processed in compact recording appliances not requiring specific maintenance, thermal recording materials are widely used in the art. For example, they are used in the field of instrumental recorders, terminal printers for computers, facsimiles, vending machines, bar-code labelers, etc. The recent requirement for such thermal recording materials is that they shall have high-level quality. Specifically, the indispensable properties of thermal recording materials for such applications are that their whiteness is high and their sensitivity (color-forming ability) is high and good, and that high-density images can be formed thereon.

After printed thereon, thermal recording materials are often stored and/or transported while kept in contact with polyvinyl chloride or the like. Therefore, they are required to be resistant to plasticizers such as polyvinyl chloride.

The resistance of thermal recording materials to plasticizers such as polyvinyl chloride can be improved in some degree by suitably selecting the constitutive components such as electron-donating leuco-dyes and electron-receiving compounds for them, or by forming a protective layer on the materials. For example, it is known that using 2,2-bis(4-hydroxyphenyl)propane (bisphenol A, BPA) for the electron-receiving compound in the materials improves the plasticizer resistance of the materials, but is not satisfactory. On the other hand, it is also known that a protective layer of polyvinyl alcohol or the like, if formed thereon, improves the plasticizer resistance of the materials.

However, in cases where thermal recording materials are used for tickets and the like, they require a combined system of thermal recording and offset printing for printing image information thereon. In that case, the protective layer, if on the thermal recording materials for such applications, often causes uneven ink adhesion to the materials printed in offset systems, and, as a result, the materials lose good printability. (The "printability" is in offset printing systems, and the same shall apply hereinafter.)

On the other hand, recently, inkjet printers have become popular for directly outputting data in prints from personal computers. In offices and others in that situation, inkjet recording materials and thermal recording materials are often put together while their recording faces are kept in contact with each other. However, conventional thermal recording materials are not satisfactorily resistant to ink for inkjet printers. Therefore, when the recording face of such thermal recording materials is kept in contact with that of inkjet recording materials, there often occurs a problem in that the density of the images formed on the materials is lowered. To solve the problem, thermal recording materials are further required to have good resistance to inkjet ink.

SUMMARY OF THE INVENTION

The present invention has been made in consideration of the problems noted above, and an object of the present invention is to provide a thermal recording material having the advantages of high sensitivity, high-density color image formation thereon, good resistance to plasticizers, good resistance to ink for inkjet systems, good traveling in processing and printing systems, good handlability (resistance to rubbing), and good printability.

The above object of the present invention is attained as follows.

In its first aspect, the present invention provides a thermal recording material including a support, and a thermal color forming layer and a protective layer formed in that order on the support, the thermal color forming layer containing an electron-donating leuco-dye and an electron-receiving compound, and the protective layer containing inorganic pigment and at least one of amide-denatured polyvinyl alcohol and diacetone-denatured polyvinyl alcohol.

Subsidiary to the first aspect thereof, the second aspect of the present invention indicates that the protective layer in the thermal recording material includes an overcoat layer (A), which contains as principal constituents inorganic pigment and a water-soluble polymer, and another overcoat layer (B), which is formed on the overcoat layer (A) and contains as principal constituents a lubricant and another water-soluble polymer, and that the water-soluble polymer contained in the overcoat layer (A) includes at least a portion of the at least one of amide-denatured polyvinyl alcohol and diacetone-denatured polyvinyl alcohol.

In a preferred embodiment of the first aspect, the protective layer further contains a surfactant; in another preferred embodiment thereof, the protective layer contains at least one water-soluble polymer selected from the group consisting of denatured polyvinyl alcohols, starch, oxidized starch, urea-phosphorylated starch, styrene-maleic anhydride copolymers, alkyl esters of styrene-maleic anhydride copolymers, and styrene-acrylic acid copolymers; and in still another preferred embodiment thereof, the protective layer has a thickness of from 0.5 $\mu$m to 3 $\mu$m.

Subsidiary to the first aspect thereof, a third aspect of the present invention indicates that the at least one of amide-denatured polyvinyl alcohol and diacetone-denatured polyvinyl alcohol in the thermal recording material is crosslinked by a crosslinking agent.

In a preferred embodiment of this aspect, the amount of the crosslinking agent to be added is in the range of 2 to 40% by weight of at least one of the amide-denatured polyvinyl alcohol and diacetone-denatured polyvinyl alcohol; in another preferred embodiment this aspect, the crosslinking agent is selected from the group consisting of polyaldehyde compounds, titanium lactate, dihydrazide compounds and boric acid; in still another preferred embodiment thereof, the crosslinking agent is selected from polyaldehyde compounds and titanium lactate.

Also preferably in the second aspect, the crosslinking agent is in the overcoat layer (A).

Subsidiary to the first aspect thereof, a fourth aspect of the present invention indicates that the inorganic pigment in the thermal recording material comprises at least one selected from the group consisting of kaolin, aluminum hydroxide, calcium carbonate, zinc oxide, aluminum oxide, titanium dioxide, silicon dioxide, barium sulfate, zinc sulfate, talc, clay, calcined clay and colloidal silica.

Preferably in this, the amount of the inorganic pigment in the protective layer is in the range of 10 to 90% by weight of the layer.

Subsidiary to the second aspect thereof, the fourth aspect of the present invention indicates that the lubricant in the thermal recording material is at least one selected from the group consisting of zinc stearate, calcium stearate, paraffin wax, microcrystalline wax, carnauba wax, and synthetic polymer wax. Preferably in this, the lubricant has a mean particle size of at most 0.5 $\mu$m.

Subsidiary to the first aspect thereof, a fifth aspect of the present invention indicates that the electron-receiving compound in the thermal recording material is at least one selected from the group consisting of 2,4'-dihydroxydiphenyl sulfone, 2,4-bis(phenylsulfonyl)phenol, 4,4'-sulfonylbis(2-(2-propenyl)phenol) and 2-hydroxy-4'-isopropoxydiphenyl sulfone.

Subsidiary to the first aspect thereof, a sixth aspect of the present invention indicates that the electron-donating leuco-dye in the thermal recording material is at least one selected from the group consisting of phthalide compounds, fluoran compounds, phenothiazine compounds, indolylphthalide compounds, leuco-auramine compounds, rhodamine-lactam compounds, triphenylmethane compounds, triazene compounds, spiropyran compounds, pyridine compounds, pyrazine compounds, and fluorene compounds.

DESCRIPTION OF THE PREFERRED EMBODIMENTS

The thermal recording material of the present invention comprises a thermal color-forming layer and a protective layer formed on a support in that order.

The constitutive components of the material of the present invention are described in detail hereinafter.

The thermal recording material of the present invention has a protective layer formed on its thermal color-forming layer. The protective layer contains at least one of an amide-denatured polyvinyl alcohol and a diacetone-denatured polyvinyl alcohol, and an inorganic pigment. The protective layer may further contain a surfactant, a thermo-fusible substance, etc.

The amide-denatured polyvinyl alcohol to be in the protective layer in the present invention is a polyvinyl alcohol of which the hydroxyl group is denatured with an amide. For example, it includes EP240 (manufactured by Denki Kagaku Kogyo) and NP20H (manufactured by Denki Kagaku Kogyo). The diacetone-denatured polyvinyl alcohol is a polyvinyl alcohol in which the hydroxyl group is denatured with a diacetone, and it includes, for example, D-700 (manufactured by Unitika) and D-500 (manufactured by Unitika).

In the protective layer, the amount of at least one of the amide-denatured polyvinyl alcohol and diacetone-denatured polyvinyl alcohol preferably is in the range of 10 to 90% by weight, and more preferably is in the range of 20 to 80% by weight.

Preferably, at least one of the amide-denatured polyvinyl alcohol and diacetone-denatured polyvinyl alcohol is crosslinked with a crosslinking agent. Containing such a crosslinked polymer component in its protective layer, the thermal recording material of the present invention is more resistant to plasticizer and has better printability. The crosslinking agent includes, for example, polyamine compounds such as ethylenediamine; polyaldehyde compounds such as glyoxal, glutaraldehyde, dialdehyde; dihydrazide compounds such as adipic acid dihydrazide, phthalic acid dihydrazide; water-soluble methylol compounds (e.g., urea, melamine, phenol); polyfunctional epoxy compounds; polyvalent metal salts (e.g., Al, Ti, Zr or Mg salts); titanium lactate and boric acid.

Of those, preferred are polyaldehyde compounds, polyvalent metal salts, dialdehyde compounds, titanium lactate, dihydrazide compounds, and boric acid; more preferred are polyaldehyde compounds and titanium lactate; and even more preferred are dialdehyde compounds and titanium lactate.

For the crosslinking agent, preferred are at least one of dialdehyde compounds and titanium lactate. More preferred is a combination of a dialdehyde compound and titanium lactate, as its ability to improve the printability of the thermal recording material containing it is especially good.

The amount of the crosslinking agent to be added to at least one of the amide-denatured polyvinyl alcohol and diacetone-denatured polyvinyl alcohol preferably is in the range of 2 to 40% by weight, and more preferably is in the range of 5 to 30% by weight of the polymer component. In cases where two or more different types of crosslinking agents are combined for use herein, it is desirable that the total amount of the agents combined falls within the range as above.

The inorganic pigment to be in the protective layer includes, for example, aluminum hydroxide, kaolin, calcium carbonate, zinc oxide, aluminum oxide, titanium dioxide, silicon dioxide, barium sulfate, zinc sulfate, talc, clay, calcined clay and colloidal silica. Of those, aluminum hydroxide and kaolin are preferred for the inorganic pigment, as their ability to improve the plasticizer resistance of the thermal recording material containing any of them is better. The main particle size of the inorganic pigment is not specifically defined. For example, it is desirable that the volume-average particle size of aluminum hydroxide for the protective layer is in the range of 0.5 $\mu$m to 0.9 $\mu$m. In the protective layer, the amount of the inorganic pigment preferably is in the range of 10 to 90% by weight, and more preferably is in the range of 20 to 80% by weight of the protective layer.

Provided such does not interfere with the effect of the present invention, the protective layer may further contain any other water-soluble polymer in addition to at least one of the amide-denatured polyvinyl alcohol and diacetone-denatured polyvinyl alcohol. The water-soluble polymer includes, for example, polyvinyl alcohol, denatured polyvinyl alcohols except at least one of amide-denatured polyvinyl alcohol and diacetone-denatured polyvinyl alcohol, starch, oxidized starch, denatured starches such as urea-phosphorylated starch, and carboxyl-containing polymers such as styrene-maleic anhydride copolymers, alkyl esters of styrene-maleic anhydride copolymers and styrene-acrylic acid copolymers.

The protective layer may contain a surfactant. Containing a surfactant, the protective layer is preferable as its ability to improve the resistance of the thermal recording material to inkjet ink is better. The surfactant includes, for example, alkylbenzenesulfonates such as sodium dodecylbenzenesulfonate; salts of alkylsulfosuccinates such as sodium dioctylsulfosuccinate; polyoxyethylene alkyl ether phosphates, sodium hexametaphosphate, and salts of perfluoroalkylcarboxylic acids. Of those, more preferred are salts of alkylsulfosuccinates, and polyoxyethylene alkyl ether phosphates. In the protective layer, the amount of the surfactant preferably is in the range of 0.5 to 10% by weight, and more preferably is in the range of 1 to 5% by weight of the layer.

In addition, the protective layer may further contain a lubricant, a defoaming agent, a fluorescent brightener and an organic color pigment, provided such does not interfere with the effect of the present invention. The lubricant includes, for example, metal soap such as zinc stearate, calcium stearate; and wax such as paraffin wax, microcrystalline wax, carnauba wax, synthetic polymer wax.

One preferred embodiment of the protective layer comprises an overcoat layer (A) which contains, as the principal constituents, an inorganic dye and a water-soluble polymer, and another overcoat layer (B) formed on the overcoat layer (A) which contains, as the principal constituents, a lubricant and a water-soluble polymer, wherein the water-soluble polymer in the overcoat layer (A) is at least one of the amide-denatured polyvinyl alcohol and diacetone-denatured polyvinyl alcohol mentioned above.

In this embodiment of the protective layer that comprises the overcoat layer (A) and the overcoat layer (B), the overcoat layer (A) may have the same constitution as that of the protective layer described above. Preferably the overcoat layer (B) overlies the overcoat layer (A), as will be mentioned hereinafter.

The thickness of the overcoat layer (A) preferably is in the range of 0.5 $\mu$m to 7 $\mu$m, and more preferably is in the range of 1 $\mu$m to 5 $\mu$m. Having the thickness that falls within the defined range of 0.5 $\mu$m to 7 $\mu$m, the overcoat layer (A) is more effective for improving the plasticizer resistance and the sensitivity of the thermal recording material comprising it.

The overcoat layer (B) comprises, as the principal constituents, a lubricant and a water-soluble polymer, and may optionally contain a defoaming agent, a fluorescent brightener and an organic color pigment, provided such does not interfere with the effect of the present invention. The lubricant includes, for example, metal soap such as zinc stearate, calcium stearate; and wax such as paraffin wax, microcrystalline wax, carnauba wax, synthetic polymer wax. Of the metal soap for it, especially preferred is zinc stearate. Of the wax, especially preferred is synthetic polymer wax, and more preferred is acrylic wax. Acrylic wax is generally prepared in the form of a milky white, anionic emulsion, and it has high affinity for aliphatic and aromatic solvents and sharp response to thermal fusion.

Preferably, the mean particle size of the lubricant is not more than 0.5 $\mu$m, and more preferably is in the range of 0.1 $\mu$m to 0.3 $\mu$m. The lubricant of which the mean particle size is not more than 0.5 $\mu$m augments the plasticizer resistance of the overcoat layers (A) and (B). This will be because, when the lubricant having such a small mean particle size of not more than 0.5 $\mu$m is in the overcoat layer (B), it migrates little to the other overcoat layer (A) while the protective layer comprising (A) and (B) is formed.

The mean particle size of the wax for use herein may be determined through laser diffractiometry.

The water-soluble polymer to be in the overcoat layer (B) is not specifically defined, including, for example, polyvinyl alcohol and its derivatives, starch, oxidized starch, denatured starches such as urea-phosphorylated starch, acrylic resins, starch, styrene-maleic anhydride copolymers, alkyl esters of styrene-maleic anhydride copolymers, and styrene-acrylic acid copolymers.

The ratio by weight of lubricant/water-soluble polymer in the overcoat layer (B) preferably is in the range of 90/10 to 10/90, and more preferably is in the range of 70/30 to 30/70 by weight. The dry weight of the overcoat layer (B) preferably is in the range of 0.01 g/m$^2$ to 3 g/m$^2$, and more preferably is in the range of 0.05 g/m$^2$ to 1.5 g/m$^2$. Having the dry weight falling within the range of 0.01 g/m$^2$ to 3 g/m$^2$, the overcoat layer (B) ensures good handlability and good run of the thermal recording material in processing and printing systems, and ensures high sensitivity of the material.

For forming the protective layer comprising the overcoat layer (A) and the overcoat layer (B), for example, coating liquids for the two layers (A), (B) are separately prepared by at least one of dissolving and dispersing the constituent components of each layer, and they are applied in order onto the predetermined layer.

For crosslinking at least one of the amide-denatured polyvinyl alcohol and diacetone-denatured polyvinyl alcohol with the crosslinking agent as above, the crosslinking agent may be added to the coating liquids, and the coating liquids are coated and dried in the manner as above; or the crosslinking agent may be added to the layer neighboring to the protective layer, and at least one of the amide-denatured polyvinyl alcohol and diacetone-denatured polyvinyl alcohol in the protective layer may be crosslinked by it. For preparing the coating liquids, for example, an inorganic pigment dispersion of which the mean particle size falls within the desired range as above may be first prepared by the use of a dispersing machine such as a sand mill, and the resulting dispersion may be added to an aqueous solution containing at least one of the amide-denatured polyvinyl alcohol and diacetone-denatured polyvinyl alcohol. For preparing the coating liquids, a solvent may be used. The solvent may be water, or a mixed solvent consisting essentially of water and containing a hydrophilic organic solvent such as alcohol.

The coating method for the coating liquids is not specifically defined, for which, for example, usable is any of air knife coater, roll coater, blade coater and curtain coater. Of those, curtain coater is preferred for forming the protective layer, especially the overcoat layers (A) and (B), as the sensitivity of the thermal recording material having the protective layer formed in that manner is high. If desired, the layer formed by coating and drying the coating liquid, preferably the overcoat layer (B) may be calendered to smooth its surface.

Preferably, the protective layer is formed on the thermal color-forming layer by applying the coating liquid for it thereonto in such a controlled manner that the dry weight of the protective layer formed may be in the range of 0.5 to 3 g/m$^2$. Also preferably, the thickness of the protective layer is in the range of 0.5 $\mu$m to 3 $\mu$m.

The thermal recording material of the present invention has a thermal color-forming layer that forms colors when having received heat. The thermal color-forming layer contains at least an electron-donating leuco-dye (an electron-donating colorless dye) and an electron-receiving compound, and may optionally contain a sensitizer, a pigment and an image stabilizer. The electron-donating leuco-dyes reacts with the electron-receiving compound under heat to form colors. For example, the electron-donating leuco-dye and the electron-receiving compound are dispersed in a binder such as resin in the layer, and they are kept separated from each other at room temperature, and when heated, they are diffused to be brought into contact with each other to thereby form colors.

The electron-donating leuco-dye includes, for example, phthalide compounds, fluoran compounds, phenothiazine compounds, indolylphthalide compounds, leuco-auramine compounds, rhodamine-lactam compounds, triphenylmethane compounds, triazene compounds, spiropyran compounds, pyridine compounds, pyrazine compounds, and fluorene compounds.

The phthalide compounds are described, for example, in U.S. Pat. Reissued No.23,024; U.S. Pat. Nos. 3,491,111, 3,491,112, 3,491,116 and 3,509,174. Specifically, they are 3,3-bis(p-dimethylaminophenyl)-6-dimethylaminophthalide, 3,3-bis(p-diethylamino-o-butoxyphenyl)-4-azaphthalide, 3-(p-diethylamino-o-butoxyphenyl)-3-(1-pentyl-2-methylindol-3-yl)-4-azaphthalide, and 3-(p-dipropylamino-o-methylphenyl)-3-(1-octyl-2-methylindol-3-yl)-5-aza (or -6-aza, or -7-aza) phthalide.

The fluoran compounds are described, for example, U.S. Pat. Nos. 3,624,107, 3,627,787, 3,641,011, 3,462,828, 3,681,390, 3,920,510 and 3,959,571. Specifically, they are 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-ethyl-N-tetrahydrofurfurylaminofluoran, 2-anilino-3-methyl-6-piperidinoaminofluoran, 2-(o-chloroanilino)-6-diethylaminofluoran, and 2-(3,4-dichloroanilino)-6-diethylaminofluoran etc.

The thiazine compounds include, for example, benzoylleucomethylene blue, and p-nitrobenzylleucomethylene blue etc.

The leucoauramine compounds include, for example, 4,4'-bisdimethylaminobenzhydrin benzyl ether, N-halophenyl-leucoauramine, and N-2,4,5-trichlorophenyl-leucoauramine etc.

The rhodamine-lactam compounds include, for example, rhodamine-B-anilinolactam, and rhodamine-(p-nitrino) lactam etc.

The spiropyran compounds are described, for example, in U.S. Pat. No. 3,971,808. Specifically, they are 3-methyl-spiro-dinaphthopyran, 3-ethyl-spiro-dinaphthopyran, 3,3'-dichlcoro-spiro-dinaphthopyran, 3-benzylspiro-dinaphthopyran, 3-methyl-naphtho-(3-methoxybenzo) spiropyran, and 3-propyl-spiro-dibenzopyran.

The pyridine compounds and pyrazine compounds are described, for example, in U.S. Pat. Nos. 3,775,424, 3,853,869 and 4,246,318.

The fluorene compounds are described, for example, in Japanese Patent Application Laid-Open (JP-A) No. 63-94878.

For use herein, the electron-donating leuco-dyes that color in black include, for example, 3-di(n-butylamino)-6-methyl-7-anilinofluoran, 2-anilino-3-methyl-6-N-ethyl-N-sec-butylaminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino)-6-methyl-7-anilinofluoran, 3-di(n-butylamino)-7-(2-chloroanilino)fluoran, 3-diethylamino-7-(2-chloroanilino) fluoran, 3-diethylamino-6-methyl-7-anilinofluoran, and 3-(N-cyclohexyl-N-methylamino)-6-methyl-7-anilinofluoran.

Of those, preferred are 3-di(n-butylamino)-6-methyl-7-anilinofluoran, 2-anilino-3-methyl-6-N-ethyl-N-sec-butylaminofluoran, and 3-diethylamino-6-methyl-7-anilinofluoran, as they retard background fogging in the non-image area of the material.

Also for use herein, other electron-donating leuco-dyes to form cyan, magenta and yellow colors are described in U.S. Pat. No. 4,800,149. For yellow, the electron-donating leuco-dyes described in U.S. Pat. No. 4,800,148 are usable herein; and for cyan, those described in Japanese Patent Application Laid-Open (JP-A) No. 63-53542 are usable herein.

The amount of the electron-donating leuco-dye to be in the color-forming layer preferably is in the range of 0.1 to 1.0 g/m$^2$, and more preferably is in the range of 0.2 to 0.5 g/m$^2$ in view of the color density and the background fog density.

The electron-receiving compound includes, for example, phenolic derivatives, salicylic acid derivatives, metal salts of aromatic carboxylic acids, acid clay, bentonite, novolak resins, metal-processed novolak resins, and metal complexes etc. Specifically, they are described in, for example, Japanese Patent Application Bulletin (JP-B) No.40-9309, JP-B No.45-14039; and JP-A No.52-140483, JP-A No.48-51510, JP-A No.57-210886, JP-A No.58-87089, JP-A No.59-11286, JP-A No.60-176795, JP-A No.61-95988.

Of those, the phenolic derivatives include, for example, 2,2'-bis(4-hydroxyphenol)propane, 4-t-butylphenol, 4-phenylphenol, 4-hydroxy-diphenoxide, 1,1'-bis(3-chloro-4-hydroxyphenyl)cyclohexane, 1,1'-bis(4-hydroxyphenyl) cyclohexane, 1,1'-bis(3-chloro-4-hydroxyphenyl)-2-ethylbutane, 4,4'-sec-isooctylidene-diphenol, 4,4'-sec-butylidene-diphenol, 4-tert-octylphenol, 4-p-methylphenylphenol, 4,4'-methylcyclohexylidene-phenol, 4,4'-isopentylidene-phenol, and benzyl p-hydroxybenzoate.

The salicylic acid derivatives include, for example, 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and their salts with zinc, aluminum, calcium, copper or lead etc.

In particular, the electron-receiving compounds capable of forming high-density colors when combined with the electron-donating leuco-dyes for black coloration mentioned above are 2,2'-bis(4-hydroxyphenol)propane (bisphenol A), 4-t-butylphenol, 4-phenylphenol, 4-hydroxy-diphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidene-diphenol, 4,4'-sec-butylidene-diphenol, 4-tert-octylphenol, 4-p-methylphenylphenol, 4,4'-methylcyclohexylidene-phenol, 4,4'-isopentylidene-phenol, 4-hydroxy-4-isopropyloxydiphenyl sulfone, benzyl p-hydroxybenzoate, 4,4'-dihydroxydiphenyl sulfone, and 2,4'-dihydroxydiphenyl sulfone. Above all, at least one selected from the group consisting of 2,4'-dihydroxydiphenyl sulfone, 2,4-bis (phenylsulfonyl)phenol, 4,4'-sulfonylbis(2-(2-propenyl) phenol) and 2-hydroxy-4'-isopropoxydiphenyl sulfone is preferred for the electron-receiving compound, as more effective for improving the plasticizer resistance of the thermal recording material containing it.

The amount of the electron-receiving compound to be in the thermal color-forming layer preferably is in the range of 50 to 400% by weight, and more preferably is in the range of 100 to 300% by weight of the electron-donating leuco-dye therein.

The thermal color-forming layer in the thermal recording material of the present invention preferably contains a sensitizer. For the sensitizer, preferred are 2-benzyloxynaphthalene and aliphatic amides. The aliphatic amides are preferably stearamide, palmitamide, ethylenebisstearamide, and methylolstearamide. The amount of the sensitizer to be in the layer preferably is in the range of 75 to 200 parts by weight, and more preferably is in the range of 100 to 150 parts by weight, relative to 100 parts by weight of the electron-receiving compound therein. Containing the sensitizer within the range of 75 to 200 parts by weight, the sensitivity of the recording material is high and the image storability thereof is good.

Other examples of the sensitizer that may be in the thermal recording material of the present invention are stearylurea, p-benzylbiphenyl, di(2-methylphenoxy)ethane, di(2-methoxyphenoxy)ethane, β-naphthol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediol-phenyl ether, diethylene glycol-bis(4-methoxyphenyl) ether, m-terphenyl, methyl oxalate benzyl ether, 1,2-diphenoxymethylbenzene, 1,2-bis(3-methylphenoxy)ethane, and 1,4-bis(phenoxymethyl) benzene etc.

The thermal color-forming layer in the thermal recording material of the present invention may preferably contain a pigment. The pigment includes, for example, amorphous silica, cubic-system calcium carbonate, burred calcium carbonate, aluminum hydroxide and kaolin. Of those, preferred are basic pigments such as calcium carbonate and aluminum hydroxide, as not causing so much background fogging in the thermal recording material.

The thermal color-forming layer in the thermal recording material of the present invention may contain an image stabilizer. For the image stabilizer, preferred is 1,1,3-tris(2-methyl-4-hydroxy-5-tert-butylphenyl)butane. The amount of the image stabilizer to be in the layer preferably is in the range of 10 to 100 parts by weight, and more preferably is in the range of 30 to 60 parts by weight relative to 100 parts by weight of the electron-donating leuco-dye therein. For the image stabilizer, also effective are phenolic compounds, especially hindered phenolic compounds. They include, for example, 1,1,3-tris(2-methyl-4-hydroxy-tert-butylphenyl) butane, 1,1,3-tris(2-ethyl-4-hydroxy-5-cyclohexylphenyl) butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

The thermal color-forming layer in the thermal recording material of the present invention may contain a binder to form the layer. The binder may be a water-soluble binder, including, for example, polyvinyl alcohol, methyl cellulose, carboxymethyl cellulose, starches (including denatured starches), gelatin, arabic gum, casein, and saponified styrene-maleic anhydride copolymers. Also usable are synthetic polymer latex binders of, for example, styrene-butadiene copolymers, vinyl acetate copolymers, acrylonitrile-butadiene copolymers, methyl acrylate-butadiene copolymers, and polyvinylidene chloride, and these may be combined with the water-soluble binder as above.

The binder may be the same as the water-soluble binder that serves as a dispersion medium for the electron-donating leuco-dye and the other components in preparing the coating liquid for the thermal color-forming layer. The method of preparing the coating liquid is described below.

The thermal recording layer may be formed by first preparing a coating liquid that contains an electron-donating leuco-dye, an electron-receiving compound and other optional components, followed by applying the resulting coating liquid onto a support and drying it thereon (in cases where the support is coated with an undercoat layer that will be mentioned below, the coating liquid is applied onto the undercoat layer). In preparing the coating liquid, preferably, the electron-donating leuco-dye and the electron-receiving compound are separately dispersed in an aqueous solution of a water-soluble binder. For example, the electron-donating leuco-dye and the electron-receiving compound are separately dispersed in an aqueous solution of a water-soluble binder by the use of a dispersing machine such as a sand mill, and the resulting dispersions are mixed to prepare the coating liquid. Preferably, the water-soluble binder is a compound having a solubility in water at 25° C. of at least 5% by weight. Examples of the water-soluble binder are polyvinyl alcohol, methyl cellulose, carboxymethyl cellulose, starches (including denatured starches), gelatin, arabic gum, casein, and saponified styrene-maleic anhydride copolymers.

In preparing the coating liquid for the thermal color-forming layer, the electron-receiving compound is preferably dispersed in an aqueous solution of such a water-soluble binder. Regarding its particle size, a volume-average particle size of the dispersion is preferably not more than 1.0 μm, and more preferably is in the range of 0.5 μm to 0.7 μm. The volume-average particle size of the dispersion is within the range defined as above is effective for increasing the color density of the images to be formed in the layer. The volume-average particle size of the dispersion may be readily measured with a laser-diffractometric particle size analyzer (for example, Horiba's LA500).

The electron-donating leuco-dye, electron-receiving compound, sensitizer and other constituent components mentioned above may be dispersed all together or separately in a dispersion medium (that is, an aqueous solution of a water-soluble binder) by the use of a stirring grinder such as a ball mill, an attritor, a sand mill or the like to prepare the coating liquid for the thermal color-forming layer. The coating liquid may contain, if desired, any of metal soap, wax, surfactant, antistatic agent, UV absorbent, defoaming agent, and fluorescent dye etc.

For the metal soap, usable are metal salts of higher fatty acids, such as zinc stearate, calcium stearate and aluminum stearate. For the wax, usable are paraffin wax, microcrystalline wax, carnauba wax, methylolstearamide, polyethylene wax, polystyrene wax and fatty acid amide-type wax, either singly or as combined. For the surfactant, usable are alkali metal salts and ammonium salts of alkylbenzenesulfonates, alkali metal salts of sulfosuccinic acids, and fluorine-containing surfactants.

The coating method for the coating liquid is not specifically defined, for which, for example, usable is any of air knife coater, roll coater, blade coater and curtain coater. Of those, curtain coater is preferred for forming the thermal color-forming layer, as the sensitivity of the layer formed in that manner is high. If desired, the layer formed by coating and drying the coating liquid may be calendered to smooth its surface.

Preferably, the thermal color-forming layer is formed on the support in such a controlled manner that its dry weight is in the range of 1 to 7 g/m$^2$. Also preferably, the thickness of the layer is in the range of 1 to 7 $\mu$m.

The support for the thermal recording material of the present invention may be any conventional supports. Specifically, it may be any of paper supports including woodfree paper, coated paper prepared by coating paper with resin or pigment, resin-laminated paper, woodfree paper or synthetic paper coated with an undercoat layer, and plastic films.

Preferably, the support has a degree of surface smoothness of at least 150 seconds, measured according to JIS-P8119, as it ensures good dot reproducibility on the recording material comprising it.

If desired, the support may be coated with an undercoat layer. Preferably, the undercoat layer contains binder and pigment. The pigment may be any ordinary inorganic or organic pigment, but is preferably one having a degree of oil absorption of at least 40 ml/100 g (cc/100 g) measured according to JIS-K5101. Specifically, it includes calcium carbonate, barium sulfate, aluminum hydroxide, kaolin, calcined kaolin, amorphous silica, and urea-formalin resin powder. Of those, preferred is calcined kaolin having a degree of oil absorption of from 70 ml/100 g to 80 ml/100 g.

The amount of the pigment to be coated on the support is preferably at least 2 g/m$^2$, more preferably at least 4 g/m$^2$, even more preferably in the range of 7 g/m$^2$ to 12 g/m$^2$.

The binder for the undercoat layer may be any of a water-soluble polymer or an aqueous binder. One or more different types of such compounds may be used for the binder, either singly or as combined. The water-soluble polymer includes, for example, starch, polyvinyl alcohol, polyacrylamide, carboxymethyl cellulose, methyl cellulose, and casein.

The aqueous binder is generally synthetic rubber latex or synthetic resin emulsion, including, for example, styrene-butadiene rubber latex, acrylonitrile-butadiene rubber latex, methyl acrylate-butadiene rubber latex, and polyvinyl acetate emulsion.

The amount of the binder to be used in forming the undercoat layer generally is in the range of 3 to 100% by weight, but preferably is in the range of 5 to 50% by weight, and more preferably is in the range of 8 to 15% by weight of the pigment to be added to the undercoat layer. If desired, the undercoat layer may contain any of wax, color erasure inhibitor, and surfactant.

For forming the undercoat layer, any known coating method is employable. Specifically, it may be formed in any mode of using an air-knife coater, a roll coater, a blade coater, a gravure coater, or a curtain coater. For it, however, especially preferred is a blade coater. Further if desired, the undercoated support may be leveled, for example, through calendering.

EXAMPLES

The present invention is described more specifically with reference to the following Examples, which, however, are not intended to restrict the scope of the present invention. Unless otherwise specifically indicated, "parts" and "%" in the following Examples are all by weight.

The mean particle size referred to hereinafter is measured with Horiba's LA-500.

Example 1

Preparation of Coating Liquid for Thermal Color-Forming Layer

Preparation of Dispersion A (of Electron-donating Leuco-dye)

| Dispersed in a ball mill, the following ingredients were mixed to prepare a dispersion having a mean particle size of 0.8 $\mu$m. | |
|---|---|
| 2-Anilino-3-methyl-6-diethylaminofluoran | 10 parts |
| Aqueous solution of 2.5% polyvinyl alcohol (Kuraray's PVA-105, having a degree of saponification of 98.5 mole % and a degree of polymerization of 500) | 50 parts |

Preparation of Dispersion B (of Electron-receiving Compound)

| Dispersed in a ball mill, the following ingredients were mixed to prepare a dispersion having a mean particle size of 0.8 $\mu$m. | |
|---|---|
| Bisphenol A | 20 parts |
| Aqueous solution of 2.5% polyvinyl alcohol (Kuraray's PVA-105) | 100 parts |

Preparation of Dispersion C (of Sensitizer)

| Dispersed in a ball mill, the following ingredients were mixed to prepare a dispersion having a mean particle size of 0.8 $\mu$m. | |
|---|---|
| 2-Benzyloxynaphthalene | 20 parts |
| Solution of 2.5% polyvinyl alcohol (Kuraray's PVA-105) | 100 parts |

Preparation of Dispersion D (of Pigment)

| Dispersed in a sand mill, the following ingredients were mixed to prepare a pigment dispersion having a mean particle size of 2.0 $\mu$m. | |
|---|---|
| Calcium carbonate | 40 parts |
| Sodium polyacrylate | 1 part |
| Water | 60 parts |

60 parts of the dispersion A, 120 parts of the dispersion B, 120 parts of the dispersion C, 101 parts of the dispersion D, 15 parts of 30% zinc stearate dispersion, 15 parts of paraffin wax (30% dispersion) and 4 parts of sodium dodecylbenzenesulfonate (25%) were mixed to prepare a coating liquid for thermal color-forming layer.

Preparation of Coating Liquid for Protective Layer

| Dispersed in a sand mill, the following ingredients were mixed to prepare a pigment dispersion having a mean particle size of 2.0 $\mu$m. | |
|---|---|
| Calcium carbonate | 40 parts |
| Sodium polyacrylate | 1 part |
| Water | 60 parts |

101 parts of the dispersion D was mixed with 840 parts of an aqueous solution of 8% amide-denatured polyvinyl alcohol, and then further mixed with 25 parts of an emulsified dispersion of zinc stearate having a mean particle size of 0.15 μm (Chukyo Yushi's Hidorin F115) and 125 parts of an aqueous solution of 2% sodium 2-ethylhexylsulfosuccinate to prepare a coating liquid for protective layer.

Fabrication of Thermal Recording Material

Using an air knife coater, the coating liquid for thermal color-forming layer prepared in the above was applied onto a support of undercoated paper (prepared by forming an undercoat layer (10 g/m$^2$) consisting essentially of pigment and binder, on woodfree paper having a weight of 50 g/m$^2$), dried and calendered to form thereon a thermal color-forming layer having a dry weight of 4 g/m$^2$. Also using an air knife coater, the coating liquid for protective layer prepared in the above was applied onto the thermal color-forming layer, dried and calendered to form thereon a protective layer having a dry weight of 2 g/m$^2$. Thus coated, a thermal recording material of this Example was fabricated.

Example 2

A thermal recording material of Example 2 was fabricated in the same manner as in Example 1, for which, however, a curtain coater was used for coating the coating liquids to form the thermal color-forming layer the protective layer.

Example 3

A thermal recording material of Example 3 was fabricated in the same manner as in Example 2, for which, however, aluminum hydroxide having a mean particle size of 0.6 μm (Sumitomo Chemical's C-3005) was used in place of calcium carbonate in preparing the coating liquid for protective layer.

Example 4

A thermal recording material of Example 4 was fabricated in the same manner as in Example 2, for which, however, kaolin (Shiraishi Industry's Kaobright) was used in place of calcium carbonate in preparing the coating liquid for protective layer.

Example 5

A thermal recording material of Example 5 was fabricated in the same manner as in Example 3, for which, however, a crosslinking agent having the composition mentioned below was added to the coating liquid for protective layer.

| | |
|---|---|
| Aqueous 42% titanium lactate solution (Matsumoto Pharmaceutical's Orgatix TC-315) | 16 parts |
| Aqueous 42% glyoxal solution | 16 parts |

Example 6

A thermal recording material of Example 6 was fabricated in the same manner as in Example 5, for which, however, 2,4'-dihydroxydiphenyl sulfone was used in place of bisphenol A in preparing the dispersion B.

Example 7

A thermal recording material of Example 7 was fabricated in the same manner as in Example 5, for which, however, 2,4-bis(phenylsulfonyl)phenol was used in place of bisphenol A in preparing the dispersion B.

Example 8

A thermal recording material of Example 8 was fabricated in the same manner as in Example 5, for which, however, 4,4'-sulfonylbis(2-(2-propenyl)phenol) was used in place of bisphenol A in preparing the dispersion B.

Example 9

A thermal recording material of Example 9 was fabricated in the same manner as in Example 5, for which, however, 4-hydroxy-4'-isopropoxydiphenyl sulfone was used in place of bisphenol A in preparing the dispersion B.

Comparative Example 1

A thermal recording material of Comparative Example 1 was fabricated in the same manner as in Example 1, for which, however, completely saponified polyvinyl alcohol (Kuraray's PVA117) was used in place of the aqueous 8% amide-denatured polyvinyl alcohol solution.

Comparative Example 2

A thermal recording material of Comparative Example 2 was fabricated in the same manner as in Example 1, in which, however, the protective layer was not formed.

The thermal recording materials of Examples 1 to 9 and Comparative Examples 1 and 2 were tested for the sensitivity, the resistance to inkjet ink, the resistance to plasticizers and the printability, according to the test methods mentioned below. The test results are given in Table 1 below.

Sensitivity

Using a thermal printer equipped with a thermal head (Kyocera's KJT-216-8MPD1) and a pressure roll of 100 kg/cm$^2$ disposed just before the thermal head, the thermal recording materials were printed. The head voltage was 24 V; the pulse repetition period was 10 ms; the pulse width was 2.1 ms; and each sample to be printed was pressed against the pressure roll in that condition. The print density was measured with a Macbeth reflection densitometer, RD-918. Higher data indicate better sensitivity.

Inkjet Ink Resistance (IJ Resistance)

Using an inkjet printer (Epson MJ930C), an image was printed on printing paper in a mode of high-quality printing. The image-printed surface of the printing paper was kept in contact with the thermal recording material, at 25° C. for 48 hours. After this, the image density of fogging caused in the thermal recording material was measured with Macbeth RD918. Lower values indicate better inkjet ink resistance.

Plasticizer Resistance

Like in the test for sensitivity as above, the thermal recording materials were printed. The printed material was put around a paper tube having a diameter of 3 inches, with its printed surface outside. This was wrapped once with a polyvinyl chloride wrapping sheet (Shin-etsu Chemical's Polymerwrap 300), and left as such at 40° C. for 48 hours. After thus stored, the image density of the printed material was measured with Macbeth RD918. The image density of a printed material not wound around the paper tube or kept in contact with the polyvinyl chloride wrapping sheet was also measured. From the data, obtained was the ratio of the image density of the sample kept in contact with wrapping sheet to that of the sample not kept in contact with it. This indicates the image density retentiveness of the sample kept in contact with the wrapping sheet. Higher data indicate better plasticizer resistance.

Printability

Using a Dahlgren unit of a rotary-press offset printer (Taiyo Machinery's Model TOF), the thermal recording materials were continuously printed to a length of 500 m. The blanket used was Polyfinebron 100S (manufactured by Taiyo Machinery); the ink used was UV ink (Toka's Toka RNC405, Green L, T & K); the line speed was 100 m/min. The image-printed area of each sample was visually checked for the sharpness, according to the criteria mentioned below. The dampening water used in offset printing has the following composition:

| | |
|---|---|
| Etchant (Fuji Photo Film's EU-3) | 1 part |
| Isopropyl alcohol | 5 parts |
| Water | 94 parts |

Criteria for Evaluation

A: High-quality prints with no faint patch.
B: Some faint patches found, but negligible in practical use.
C: Many faint patches found.

TABLE 1

| | Sensitivity | IJ Resistance | Plasticizer Resistance | Printability |
|---|---|---|---|---|
| Example 1 | 1.23 | 0.09 | 82% | B |
| Example 2 | 1.25 | 0.08 | 88% | B |
| Example 3 | 1.26 | 0.09 | 90% | B |
| Example 4 | 1.25 | 0.08 | 92% | B |
| Example 5 | 1.23 | 0.08 | 93% | A |
| Example 6 | 1.22 | 0.08 | 97% | A |
| Example 7 | 1.21 | 0.08 | 99% | A |
| Example 8 | 1.23 | 0.08 | 98% | A |
| Example 9 | 1.22 | 0.09 | 98% | A |
| Comp. Ex. 1 | 1.23 | 0.09 | 80% | C |
| Comp. Ex. 2 | 1.30 | 0.25 | 25% | A |

Comp. Ex.: Comparative Example

As in Table 1 above, it is understood that the thermal recording materials of Examples 1 to 9 all have better IJ resistance and better plasticizer resistance than the thermal recording material of Comparative Example 2 not having a protective layer, and the sensitivity of the former is almost comparable to that of the latter. In addition, it is also understood that the thermal recording materials of Examples 1 to 9 all have better plasticizer resistance and printability than the thermal recording material of Comparative Example 1 in which the protective layer contains non-denatured polyvinyl alcohol. It is further understood that the thermal recording materials of Examples 5 to 9 in which the amide-denatured polyvinyl alcohol in the protective layer was crosslinked by the crosslinking agent therein have better plasticizer resistance and better printability than those of the other Examples. The thermal recording material of Example 2 has good sensitivity, since the protective layer and the thermal color-forming layer therein were both formed by the use of a curtain coater. The thermal recording materials of Examples 3 and 4 have good plasticizer resistance, since the inorganic pigment in the protective layer therein is aluminum hydroxide and kaolin, respectively, having a predetermined mean grain size.

The advantage of the thermal recording material of the present invention is that the plasticizer resistance and the printability of the material are both improved provided such does not interfere with the sensitivity thereof.

Example 10

Preparation of Coating Liquid for Support Undercoat Layer

Using a dissolver, the following ingredients were stirred and mixed, to which were added 20 parts of SBR (styrene-butadiene latex) and 25 parts of oxidized starch (25%) to prepare a coating liquid for a support undercoat layer.

Composition of Coating Liquid for Support Undercoat Layer

| | |
|---|---|
| Calcined kaolin (having a degree of oil absorption of 75 ml/100 g) | 100 parts |
| Sodium hexametaphosphate | 1 part |
| Distilled water | 110 parts |

Using a blade coater, the coating liquid for a support undercoat layer prepared in the above was applied onto woodfree base paper having a Stockigt sizing degree of 10 seconds and a basic weight of 50 g/m$^2$ to form thereon an undercoat layer having a dry weight of 8 g/m$^2$. After dried, the layer was then calendered. The base paper was thus coated with the undercoat layer.

Preparation of Dispersion (E) of Electron-Donating Leuco-Dye

| | |
|---|---|
| Electron-donating leuco-dye (Yamamoto Chemical's ODB-2, 3-diethylamino-6-methyl-7-anilinofluoran) | 100 parts |
| PVA (10% solution) | 100 parts |

Using a ball mill, these were finely dispersed into a dispersion E having a mean particle size of 1.0 $\mu$m.

Preparation of Dispersion (F) of Electron-Receiving Compound and Sensitizer

| | |
|---|---|
| Electron-receiving compound (2,4'-dihydroxydiphenyl sulfone) | 150 parts |
| Sensitizer (benzyl naphthyl ether) | 150 parts |
| PVA (10% solution) | 300 parts |

Using a ball mill, these were finely dispersed into a dispersion F having a mean particle size of 1.0 $\mu$m.

Preparation of Pigment Dispersion (G)

| | |
|---|---|
| Inorganic Pigment (Shiraishi Industry's Unibar 70, calcium carbonate) | 400 parts |
| Sodium hexametaphosphate (1% solution) | 400 parts |

Using a ball mill, these were finely dispersed into a dispersion G having a mean particle size of 2 $\mu$m.

The dispersion E was added to the dispersion F, to which was further added the dispersion G with stirring to prepare a coating liquid for thermal recording layer.

Fabrication of Thermal Recording Material

Using an air knife coater, the coating liquid for thermal recording layer prepared in the above was applied onto the undercoated paper support to form thereon a thermal color-forming layer having a dry weight of 5 g/m$^2$. After dried, this was then gloss-calendered. Thus was obtained thermal recording paper A having a thermal recording layer formed on the undercoated paper support.

Preparation of Coating Liquid for Overcoat Layer (A)

| | |
|---|---|
| Water | 60 parts |
| Aqueous solution of 40% sodium hexametaphosphate | 1 part |
| Aluminum hydroxide (Sumitomo Chemical's C-3005) | 40 parts |

These were mixed, and then milled in a sand mill (Willy A. Bachofen's KDL Pilot) into a fine pigment dispersion having a mean particle size of 0.6 μm.

| | |
|---|---|
| Amide-denatured PVA (Denki Kagaku Kogyo's EP240, aqueous 8% solution) | 125 parts |
| Pigment dispersion | 10 parts |
| Surfactant (Kao's Kao Neopelex F-25) | 3 parts |
| Water | 62 parts |

These were mixed to prepare a coating liquid for overcoat layer (A). This is referred to as coating liquid A.

Preparation of Coating Liquid for Overcoat Layer (B)

| | |
|---|---|
| Aqueous solution of 10% PVA117 (manufactured by Kuraray) | 100 parts |
| 40% synthetic polymer wax dispersion (Nippon Shokubai's CX-ST200, having a mean particle size of 0.2 μm) | 25 parts |
| Surfactant (Kao's Kao Neopelex F-25) | 50 parts |
| Water | 825 parts |

These were mixed to prepare a coating liquid for overcoat layer (B).

Using a bar coater, the coating liquid for overcoat layer (B) and the coating liquid for overcoat layer (A) were applied in that order onto the thermal recording paper A prepared in the above, and dried. The dry weight of each layer thus formed is shown below. Then, this was leveled through calendering at a surface temperature of 50° C. This is a thermal recording material of Example 10

| | |
|---|---|
| Overcoat Layer (A) | dry weight, 3.0 g/m$^2$ |
| Overcoat Layer (B) | dry weight, 0.1 g/m$^2$ |

Example 11

A thermal recording material of Example 11 was fabricated in the same manner as in Example 10, in which, however, the dry weight of the overcoat layer (B) was 0.01 g/m$^2$.

Example 12

A thermal recording material of Example 12 was fabricated in the same manner as in Example 10, for which, however, a crosslinking agent having the composition mentioned below was added to the coating liquid for overcoat layer (A).

| | |
|---|---|
| Aqueous 42% titanium lactate solution (Matsumoto Pharmaceutical's Orgatix TC-315) | 2.5 parts |
| Aqueous 42% glyoxal solution | 2.5 parts |

Example 13

A thermal recording material of Example 13 was fabricated in the same manner as in Example 10, for which, however, an aqueous solution of 8% diacetone-denatured PVA (Unitika's D-700) was used in place of the aqueous solution of 8% amide-denatured PVA in preparing the coating liquid for overcoat layer (A).

Example 14

A thermal recording material of Example 14 was fabricated in the same manner as in Example 13, for which, however, a crosslinking agent mentioned below was added to the coating liquid for overcoat layer (B).

| | |
|---|---|
| Aqueous 5% adipic acid dihydrazide solution | 20 parts |

Example 15

A thermal recording material of Example 15 was fabricated in the same manner as in Example 12, for which, however, an emulsified dispersion of zinc stearate (Chukyo Yushi's Himicron F930, having a mean particle size of 0.9 μm) was used in place of the synthetic polymer wax dispersion (Nippon Shokubai's CX-ST200, having a mean particle size of 0.2 μm).

Example 16

A thermal recording material of Example 16 was fabricated in the same manner as in Example 12, in which, however, the overcoat layer (A) and the overcoat layer (B) were both formed by the use of a curtain coater.

Example 17

A thermal recording material of Example 17 was fabricated in the same manner as in Example 10, in which, however, formed was only the overcoat layer (A) having a dry weight of 3.0 g/m$^2$.

Example 18

A thermal recording material of Example 18 was fabricated in the same manner as in Example 10, for which, however, the coating liquid for overcoat layer (A) was mixed with the coating liquid for overcoat layer (B) (in a ratio liquid B/liquid A of 3/30 by weight), and the resulting mixture was coated to form a protective layer having a dry weight of 3.1 g/m$^2$.

Comparative Example 3

A thermal recording material of Comparative Example 3 was fabricated in the same manner as in Example 10, for which, however, an aqueous 8% solution of completely saponified PVA (Kuraray's PVA117) was used in place of the aqueous 8% solution of amide-denatured PVA in preparing the coating liquid for overcoat layer (A).

The thermal recording materials fabricated as above were tested for their properties, according to the test methods mentioned below.

(1) Sensitivity (Color-forming Ability)

Using a thermal printer equipped with a thermal head (Kyocera's KJT-216-8MGF1, resistance 2964 Ω), the thermal recording materials were printed. The platen pressure was 1 kg/cm$^2$; the head surface temperature was 30° C.; the voltage applied to the head was 23.8 V; the pulse width was 2.1 ms; and the feed pitch was 7.7 dot/mm. The print density was measured with a Macbeth reflection densitometer, RD-918.

(2) Plasticizer Resistance

Like in the test for sensitivity as in (1), the thermal recording materials were printed. The printed sample was put around a polyvinyl chloride tube having a diameter of 3 inches, with its printed surface outside. This was wrapped with a polyvinyl chloride wrapping sheet (Shin-etsu Chemical's Polywrap 300), and put in an oven at 45° C., and kept therein for 24 hours. After thus kept, the image density of the printed sample was measured with a Macbeth densitometer, RD918. After thus tested, the printed samples still having a density of at least 0.7 are good with no problem in practical use.

(3) Running in Printing System

Using a Matsushita's facsimile (Otax PW2) loaded with the thermal recording sheets to be tested, the facsimile test chart (standardized by the Society of Electrophotography of Japan) transmitted by facsimile G3 was printed on the test sheets, and the printing noise was measured with a Lion's noise meter NA-24. The noise in printing good running samples is at most 70 dB.

(4) Handlability (Resistance to Rubbing)

The thermal recording materials were strongly rubbed with a fingernail, and their surfaces were visually checked for the presence or absence of black traces therein. The samples thus tested were evaluated for their handlability according to the criteria mentioned below. Those evaluated as "A" or "B" are good with no problem in their handlability.

A: The rubbed area did not black.

B: The rubbed area slightly blacked, but negligible.

C: The rubbed area blacked a little but to a nonnegligible degree.

D: The rubbed area blacked remarkably.

(5) Printability

Using a Dahlgren unit of a rotary-press offset printer (Taiyo Machinery's Model TOF), the thermal recording materials were continuously printed to a length of 500 m. The blanket used was Polyfinebron 100S (manufactured by Taiyo Machinery); the ink used was UV ink (Toka's Toka RNC405, Green L, T & K); the line speed was 100 m/min. The image-printed area of each sample was visually checked for the sharpness, according to the criteria mentioned below. The dampening water used in offset printing has the following composition:

| | |
|---|---|
| Etchant (Fuji Photo Film's EU-3) | 1 part |
| Isopropyl alcohol | 5 parts |
| Water | 94 parts |

Criteria for Evaluation

A: High-quality prints with no faint patch.

B: Some faint patches found, but negligible in practical use.

C: Many faint patches found.

TABLE 2

| | Sensitivity | Plasticizer Resistance | Run in Printing System (dB) | Rubbing Resistance | Printability |
|---|---|---|---|---|---|
| Example 10 | 1.23 | 0.98 | 67 | A | B |
| Example 11 | 1.24 | 1.00 | 68 | B | B |
| Example 12 | 1.23 | 0.97 | 66 | A | A |
| Example 13 | 1.21 | 0.93 | 68 | A | B |
| Example 14 | 1.19 | 0.95 | 66 | A | A |
| Example 15 | 1.20 | 0.90 | 67 | A | A |
| Example 16 | 1.25 | 0.98 | 66 | A | A |
| Example 17 | 1.20 | 0.93 | 78 | C | B |
| Example 18 | 1.19 | 0.45 | 75 | C | B |
| Comp. Ex. 3 | 1.19 | 0.93 | 67 | A | C |

Comp. Ex.: Comparative Example

As in Table 2 above, the thermal recording materials of Examples 10 to 16 all enjoy higher sensitivity, better plasticizer resistance, better running in printing systems, better rubbing resistance and better printability than the material of Comparative Example 3 not containing an amide-denatured or diacetone-denatured polyvinyl alcohol. The material of Example 17 having the overcoat layer (A) alone, and the material of Example 18 in which the protective layer was formed from a mixture of the coating liquids for overcoat layers (A) and (B), enjoy higher sensitivity, better running in printing systems, and better printability, than the material of Comparative Example 3. In total evaluation, the formers are superior to the latter.

As described in detail hereinabove with reference to its preferred embodiments, the thermal recording material which the present invention provides herein has the advantages of high sensitivity (high-density color image formation thereon), good resistance to plasticizers, good run in processing and printing systems, good handlability (resistance to rubbing), and good printability.

What is claimed is:

1. A thermal recording material comprising a support, and a thermal color forming layer and protective layers formed in that order on the support, the thermal color forming layer containing an electron-donating leuco-dye and an electron-receiving compound, the protective layers comprising two layers including an overcoat layer (A), which contains as principal constituents inorganic pigment and a water-soluble polymer, and another overcoat layer (B), which is formed on the overcoat layer (A) and contains as principal constituents a lubricant and another water-soluble polymer, at least one of the protective layers containing at least one of amide-denatured polyvinyl alcohol and diacetone-denatured polyvinyl alcohol, the water-soluble polymer contained in the overcoat layer (A) including at least a portion of the at least one of amide-denatured polyvinyl alcohol and diacetone-denatured polyvinyl alcohol, and wherein overcoat layer (B) does not comprise inorganic pigment.

2. The thermal recording material according to claim 1, wherein at least one of the protective layers further comprises a surfactant.

3. The thermal recording material according to claim 1, wherein, in addition to the at least one of amide-denatured polyvinyl alcohol and diacetone-denatured polyvinyl alcohol, at least one of the protective layers further comprises at least one water-soluble polymer selected from the group consisting of denatured polyvinyl alcohols, starch, oxidized starch, urea-phosphorylated starch, styrene-maleic anhydride copolymers, alkyl esters of styrene-maleic anhydride copolymers, and styrene-acrylic acid copolymers.

4. The thermal recording material according to claim 1, wherein the protective layers comprise a total thickness of from 0.5 $\mu$m to 3 $\mu$m.

5. The thermal recording material according to claim 1, wherein the at least one of amide-denatured polyvinyl alcohol and diacetone-denatured polyvinyl alcohol is crosslinked by a crosslinking agent.

6. The thermal recording material according to claim 5, wherein the crosslinking agent comprises a content amount of from 2 to 40% by weight relative to the at least one of amide-denatured polyvinyl alcohol and diacetone-denatured polyvinyl alcohol.

7. The thermal recording material according to claim 5, wherein the crosslinking agent comprises at least one compound selected from the group consisting of polyaldehyde compounds, titanium lactate, dihydrazide compounds and boric acid.

8. The thermal recording material according to claim 5, wherein the crosslinking agent comprises at least one compound selected from the group consisting of polyaldehyde compounds and titanium lactate.

9. The thermal recording material according to claim 5, wherein the crosslinking agent comprises an amount thereof which is contained in the overcoat layer (A).

10. The thermal recording material according to claim 1, wherein the inorganic pigment comprises at least one material selected from the group consisting of kaolin, aluminum hydroxide, calcium carbonate, zinc oxide, aluminum oxide, titanium dioxide, silicon dioxide, barium sulfate, zinc sulfate, talc, clay, calcined clay and colloidal silica.

11. The thermal recording material according to claim 1, wherein the inorganic pigment comprises at least one of kaolin and aluminum hydroxide that has a volume-average particle size of from 0.5 $\mu$m to 0.9 $\mu$m.

12. The thermal recording material according to claim 1, wherein the inorganic pigment comprises a content amount in the overcoat layer (A) in the range of from 10 to 90 % by weight of the overcoat layer (A).

13. The thermal recording material according to claim 1, wherein the lubricant comprises at least one material selected from the group consisting of zinc stearate, calcium stearate, paraffin wax, microcrystalline wax, carnauba wax, and synthetic polymer wax.

14. The thermal recording material according to claim 1, wherein the lubricant comprises a mean particle size of not more than 0.5 $\mu$m.

15. The thermal recording material according to claim 1, wherein the electron-receiving compound comprises at least one compound selected from the group consisting of 2,4'-dihydroxydiphenyl sulfone, 2,4-bis(phenylsulfonyl)phenol, 4,4'-sulfonylbis(2-(2-propenyl)phenol) and 2-hydroxy-4'-isopropoxydiphenyl sulfone.

16. The thermal recording material according to claim 1, wherein the electron-donating leuco-dye comprises at least one compound selected from the group consisting of phthalide compounds, fluoran compounds, phenothiazine compounds, indolylphthalide compounds, leuco-auramine compounds, rhodamine-lactam compounds, triphenylmethane compounds, triazene compounds, spiropyran compounds, pyridine compounds, pyrazine compounds, and fluorene compounds.

* * * * *